US005815873A

United States Patent [19]

Jones

[11] Patent Number: 5,815,873

[45] Date of Patent: Oct. 6, 1998

[54] RETRACTABLE GOLF UTILITY DEVICE

[76] Inventor: Edward H. Jones, P.O. Box 330 - 3 Spaulding Ave., Scituate, Mass. 02060

[21] Appl. No.: 592,869

[22] Filed: Jan. 24, 1996

[51] Int. Cl.[6] ..... A46B 5/02; A46B 15/00

[52] U.S. Cl. ..... 15/106; 15/161; 33/760; 7/164

[58] Field of Search ..... 15/105, 106, 160, 15/161; 33/760, 755, 679.1; 7/164; 242/371, 400

[56] References Cited

U.S. PATENT DOCUMENTS

| | | | |
|---|---|---|---|
| D. 339,473 | 9/1993 | Lewis et al. | D4/116 |
| 3,213,541 | 10/1965 | Raffman | 33/679.1 |
| 4,574,486 | 3/1986 | Dreschsler | 33/755 |
| 5,230,117 | 7/1993 | Johnson et al. | 15/106 |
| 5,555,589 | 9/1996 | Moultrie | 15/105 |

*Primary Examiner*—Tony G. Soohoo
*Attorney, Agent, or Firm*—Ernest V. Linek; Dike, Bronstein, Roberts & Cushman, LLP

[57] ABSTRACT

The present invention is directed to a unique golf accessory, which in its most basic form comprises three fundamental parts; (a) a golf club/cleat brush; (b) a recoilable wire or tape and housing therefor; and (c) means for attaching the brush to the recoilable wire or tape. In preferred embodiments, the recoilable tape or wire includes measurement indications thereon, i.e., the tape or wire is marked in feet and inches (or meters and millimeters) to allow golfers to accurately determine putting distances. In addition, the housing for the recoilable tape or wire preferably includes a member suitable for attachment to a golf bag or the clothing of the golfer.

16 Claims, 1 Drawing Sheet

RETRACTABLE GOLF UTILITY DEVICE

BACKGROUND OF THE INVENTION

I am 46 years old and have played golf since I was 12. In my 34 years of experience, I have witnessed many changes in the sport of golf and in golfing equipment. My own ability as a golfer is modest. I play a round of golf with a score generally in the 80's; typically, the high 80's. Beyond being a player, I have read extensively on the sport; its storied history, and I am a collector of sorts of golf clubs. In short, I have become aware of the evolution of the sport of golf, the evolution of golf equipment, and of golf accessories, over a period of three decades.

With the evolution and advancement of today's golf clubs, they are found to be more expensive and more precise instruments of the game. The golf club grips, shafts clubs heads are all areas of intensive design improvements. The present invention put forth here involves the maintenance of the golf club face, golf shoes and measuring distances important to the game of golf. As a golfer, I am aware that the grooves on a golf club face or the "rifling" must be kept clean and free of debris to facilitate backspin when the club face strikes the golf ball. Technological advancements on the grooves or the "rifling" of golf clubs have enabled golfers to put more backspin on the golf ball. To effectuate this action, the club face must be clean and free of debris. The present invention does this by enabling a golfer to easy access and the ready use of a scrub brush without taking the time to retrieve the brush from inside the golf bag and then returning the brush to the inside of the golf bag after use.

Often in golf, the question arises "who is farthest away from the hole." This question usually occurs on the putting surface and is important because the answer determines whose turn it is to play the next shot. The present invention advantageously includes within itself, but is not limited to, a tape measure-like means for measuring and/or indicating distances, e.g., in both feet and in inches.

In my years as a golfer, an observer of the game of golf, and as a witness to the evolution and development of the equipment used in golf, I have found a growing need for a good golf scrub brush that can easily and quickly be used and either quickly put away or easily placed out of the way. Furthermore, the ready accessibility of a tape measuring device that is similarly quickly and readily available is a growing area that needs to be addressed. Thus, my interest in developing this invention was to develop a combination golf club and golf shoe cleat scrub brush that readily attaches either to the outside of a standard golf bag, or to the clothing of the golfer, in such a manner that it does not interfere with the normal course of play. In addition, as a most preferred embodiment, the device of the present invention further incorporates a tape measuring device to aide golfers in applying the rules of the game of golf, i.e., to properly determine who is "away" when on the putting surface. This device can also serve to clarify who is closest to the pin, in those cases where golfers desire to have this knowledge.

Another device that I am aware of, but which is believed to be only remotely related to the present invention, is shown in U.S. Design Pat. No. 339,473 to Lewis et al. This patent claims "the ornamental design for a combined golf club brush and wire holder with clip, as shown and described." A review of the two drawings shown in this patent reveals that the so-called "wire holder" is actually a long spring of wire, akin to a conventional telephone cord "coil" or the like. In actual use, the wire coil is a very flexible spring-like material with a plastic coating on the outside, which allows the brush to dangle from the hook end by an unextended distance of about ten (10) inches, to an extended distance of about two (2) feet. Such a device may be suitable for attachment to a golf bag, but it could not conveniently be worn by a golfer during play. In addition, this device neither teaches nor suggests the inclusion of any means for providing measurement of putting distances. I hereby incorporate the disclosure of this patent by reference into this disclosure.

SUMMARY OF THE INVENTION

The present invention is directed to a unique golf accessory, which in its most basic form comprises three basic parts; (a) a golf club/cleat brush; (b) a recoilable wire or tape and housing therefor; and (c) means for attaching the brush to the recoilable wire or tape. In preferred embodiments, the recoilable tape or wire (23) includes measurement indications (25) thereon, i.e., the tape or wire is marked in feet and inches (or meters and millimeters) to allow golfers to accurately determine putting distances. In addition, the housing for the recoilable tape or wire preferably includes a member suitable for attachment to a golf bag or the clothing of the golfer.

To make the present invention, it is necessary to make a device that will coil and uncoil a line, wire, tape or lanyard of some type. The device is very similar to a common recoilable tape measure or retractable key chain, both of which may be readily found in any hardware store or home improvement department store. The coilable and recoilable action is typically caused by a simple spring-like mechanism located within the housing of these devices. Pulling or uncoiling the wire or tape from outside the device causes the mechanism inside the device to counter the uncoiling action by coiling a spring and thus causing a resisting action. When the end of the wire or tape outside the housing is released, the outside wire or tape recoils back to the spool inside in response to the resistance of the spring located within the device.

Further, in a preferred embodiment, the wire or tape that extends from the spool of the coil and recoiling device may be, but is not limited to, being marked in inches and feet so as to be used as a measuring device when golfers need to determine distances or as an aide in otherwise applying the rules of the game of golf.

Attached to the wire or tape, i.e., on the outside of the device, there is usually a nob or a clamp (or other like stop member) that is of sufficient size to accomplish two tasks; one task is to stop the wire or tape from retreating into the housing, thus making the wire or tape inaccessible; the other task is to allow the attachment of a ring or a clasp to the nob or clamp. Once in place, the ring or the clasp will then be used to link or join the golf club/golf shoe cleat scrub brush to the wire or tape and thus to the spring action recoil device previously described.

The golf club/golf shoe cleat scrub brush attached to the nob should be of sufficient size as to accomplish said scrubbing tasks. The bristle, or the trim of the brush, may be made out of various materials that may be, but are not limited to, wire, brass, steel, nylon, horsehair or similar scrub brush materials. The length of the trim may be, but is not limited to, ⅛" to 3" in length.

The entire invention should be capable of simple attachment to the outside of a golf bag, by, but not limited to, for instance, an open-ended clasp that may easily slip over any accessory strap, towel holder equipment, shoulder strap or many other accessible accouterment found on a standard golf bag. Alternatively, the attachment may be to the belt, belt loop, or other clothing of the golfer, preferably in an accessible, but out of the way location during play.

Preferably, at least one of (or both of) the sides of the device are flat, or otherwise capable of accepting graphics or the like. Most preferably, both the face side and the reverse side of the recoilable device are designed to accept, carry and to display visual or graphical information. This information may be, but is not limited to, company and corporate trademarks, logos, licensed copyrighted material, insignia, advertisement, golf course identification and personal identification of the user. Similarly, the golf club/golf shoe cleat scrub brush may carry and may display the same aforesaid information, e.g., on the brush handle area, or elsewhere.

DETAILED DESCRIPTION OF THE INVENTION

Figure 1:
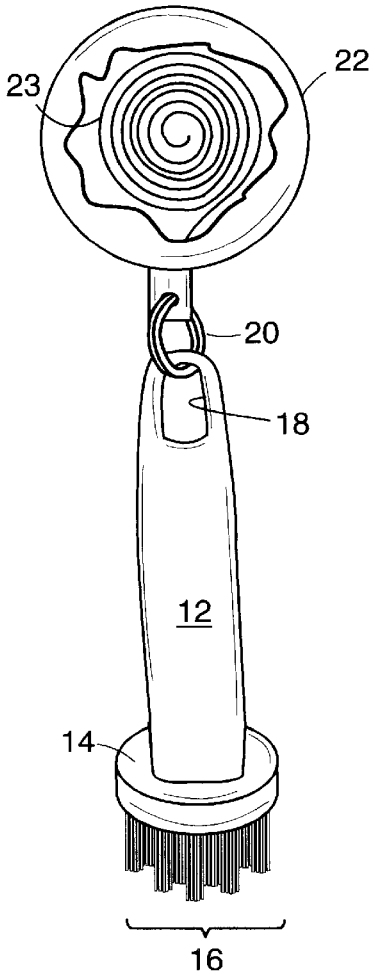
FIG. 1 shows the front view of a preferred embodiment of the present invention.
Figure 2:
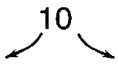
FIG. 2 shows the rear view of a preferred embodiment of the present invention.
Figure 2:
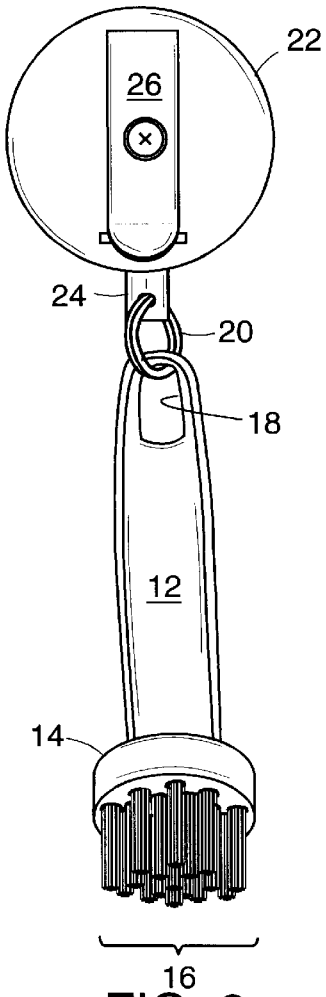

As illustrated in the two Figures accompanying this specification, the present invention is a simple device, ideally made up of, very few parts, each of which contributes greatly to the use of the invention. As shown in FIGS. 1 and 2 the present invention includes a golf club/cleat brush (10), comprising a handle (12) and a brush head (14) with bristles (16). At the end of the brush handle (12) there is a hole (18) which allows the brush (10) to be attached to the remaining parts of the invention. Brushes of this type are commercially available.

As illustrated, the brush (10) is connected via handle hole (18) to a linking member (20) which bridges the gap between the recoil housing (22) and the brush (10). The recoil tape or wire (23) is contained within the housing (22), and the end thereof is provided with a stop member (24) which prevents the wire or tape from being fully recoiled into the housing (22), thereby allowing access to the tape or wire as required. As illustrated in the preferred embodiment, stop member (24) is provided with a hole (not shown) through which linking member (20) is connected thereto. Recoil wires and tapes of the type illustrated are commercially available.

Finally, as shown in FIG. 2, the housing may be provided with a hanger member (26) for attachment to the golf bag or to the clothing of the golfer. The illustrated hanging member (26) is a metal clip, mounted to the rear face of the housing (22). Alternatively, other attachment members, such as clips, clams, hook, etc. could be employed, and the placement could be elsewhere on the housing, e.g., at the top, 180° away from the stop member (24).

Thus, as illustrated, a preferred embodiment of this invention has six main component parts; the brush (10), the linking member (20), the recoil housing (22), the recoil wire or tape (23), the stop member (24) and a hanger member (26). These six parts cooperate to provide golfers with a unique accessory device, which is both convenient and simple to use.

Figure 3:
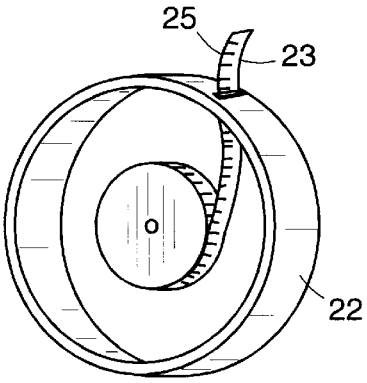
FIG. 3 shows a preferred embodiment of the present invention using a recoilable tape.
Figure 4A:
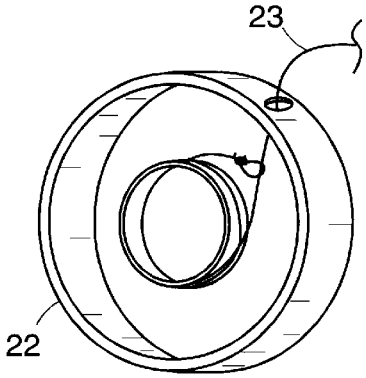
FIG. 4A shows a preferred embodiment of the present invention using a recoilable wire.
Figure 4B:
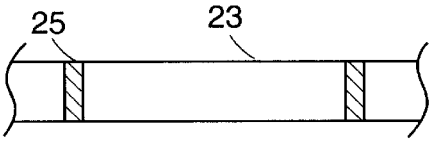
FIG. 4B shows the measurement indications of the recoilable wire of FIG. 4A.

The preferred six parts that make up the golf club/golf shoe cleat scrub brush that is attachable to the outside of a golfer's golf bag via a, but not limited to, spring action recoilable instrument that uncoils and recoils, but not limited to, a wire or string that in turn attaches to said scrub brush. Further, as seen in FIGS. 3, 4A, and 4B, the said wire or tape (23) may or may not be a measuring device (25) indicating distances in inches and feet which is valuable information in the play and rules of golf. Additionally, the length of said wire or tape measure may be, but is not limited to, a minimum of one (1) foot and not to exceed two hundred (200) feet. Further, the scrub brush should be of sufficient size to accomplish its task of effectively scrubbing clean both golf clubs and golf shoe cleats. The length of the brush may be, but is not limited to, a minimum of two (2) inches and not to exceed three (3) feet. Further, the bristle or "trim" of the brush is made of, but not limited to, nylon, brass, horsehair or steel.

The recoilable golf club and golf cleat scrub brush offers many advantages over how the task is now accomplished. Currently, a golf club and golf cleat brush must be stored inside a storage compartment inside a golfer's golf bag. These storage compartments are generally accessed by a common zipper. The reason for this, is a golf scrub brush large enough to effectively do the task of cleaning is too large and too cumbersome to fit into a golfer's pants pocket without causing some level of discomfort to the golfer during his round of play (if indeed a golfer is wearing clothes that has pockets, i.e. sport type shorts or some women's golfing apparel.) The two most common annoyances are (1) the bulge created in the pants pocket by the brush which can inhibit not only the golf swing but the putting stroke of the golfer; and (2) the scrub brush bristles commonly and routinely pierces through the pocket lining of the golfer's pants impaling the golfer's leg causing pain and irritation to the point where the golfer just no longer wants to carry the scrub brush in this manner. Each use of a scrub brush must follow the accompanying action of removing the scrub brush from the zippered golf bag storage compartment and returning said brush to said storage action following each use. This repeated action is eliminated through the use of the present invention due to the "outside" of the golf bag attachment feature of the present invention. More importantly, the brush, when used to scrub the golf club face or golf shoe cleats, the recallable action returns the brush quickly and effectively to the golf bag where said brush is automatically available for the next usage. This uncoil and recoil action after each use in addition to the golf scrub brush being located outside the golf bag reduces the time spent accomplishing the said action of scrubbing golf clubs and golf cleats.

Removing debris from golf clubs and golf cleats answers problems not known to golfers of decades ago. First, the evolution and development of today's golf clubs requires a hitting surface free of grass, soil, dirt, muck, mud, and the growing menace of goose excrement left by increasing numbers of Canada Geese inhabiting golf courses, particularly in the eastern United States. Secondly, golf shoe cleats must be kept free of debris. Golf cleats increase stability and reduce the opportunity of slipping during the golf swing. When debris accumulates on the golf shoe cleats, their desired effect is reduced or negated.

The present invention easily and effectively removes said debris and with the coil and recoilable action does this in a timely fashion offering both a time saving convenience and accessibility to a useful tool much needed in today's game of golf.

Further, the present invention offers two (2) faces to facilitate communications, for example, written or graphic information in the form of advertisements, golf course affiliations, company and/or corporation logos, and trademark identification, as well as, personal identification of the user, e.g., in the listing of the user's name and home address for golf bag identification.

The space available for said printed information may be, but is not limited to, the front and reverse of the housing of the instrument encasing the recoilable wire or tape. The shape of the said recoilable instrument may be, but is not limited to, being round, square, rectangle, triangle, oblong or any other shape. Upon the surface area(s) will be located information that may be, but not limited to, printed, embossed, engraved, silk-screened, adhesive labels or any other like process to communicate or reflect a company, corporation, service, event, trademark or logo or any other such succinct message.

Further, the aforesaid scrub brush may also, but is not limited to, similar depictions of, but not limited to, printed, embossed, engraved, silk-screened, adhesive labels or any like process on the front, rear or anywhere on the surface of said scrub brush. Also, the shape of the surface of the said scrub brush may be, but is not limited to, being shaped to form a surface that may be, but is not limited to, smooth, recessed, indented, engraved, etched, stamped, porous or any other surface that my accommodate a message to an observer of said scrub brush.

The size of the coilable and recoilable device may be, but is not limited to, a minimum of one (1) inch in diameter and up to twenty-four (24) inches in diameter. Similarly, the golf scrub brush may be, but is not limited to, one (1) inch in length and not to exceed thirty-six (36) inches in length. The bristles of said brush are to be, but not limited to, one-eighth (⅛) inch in length but not to exceed four (4) inches in length. Furthermore, the wire or tape contained inside the coilable and recoilable device may be, but is not limited to, a minimum of one (1) foot in length and not to exceed a maximum of two hundred (200) in length; preferable from about ten (10) feet to about one hundred (100) feet; and most preferably between about twenty five (25) feet and fifty (50) feet in length. The size of the housing gets larger as the length of the wire or tape therein increases, and thus, while longer tapes could be used within the scope of this invention, the housing size would make it impractical.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A retractable and recoilable golf utility device consisting essentially of; a golf club/cleat brush unit connected by an attachment means to a recoilable wire said wire being retained within a housing therefor;

wherein the golf club/cleat brush unit consists of an elongated handle member connected substantially perpendicularly to the top of a brush head member, and wherein the brush head member consists of a single field of a plurality of elongated bristles disposed on the bottom of the brush head member; and wherein the elongated handle member further includes at least one substantially flat face available for information display.

2. The golf utility device of claim 1, wherein the recoilable wire further includes measurement indications thereon.

3. The golf utility device of claim 2, wherein the measurement indications are provided in feet and inches.

4. The golf utility device of claim 2, wherein the measurement indications are provided in meters and millimeters.

5. The golf utility device of claim 2, wherein the measurement indications are provided in both feet and inches, and in meters and millimeters.

6. The golf utility device of claim 1, wherein the housing for the recoilable wire further includes attachment means suitable for attaching the housing to a golf bag.

7. The golf utility device of claim 1, wherein the housing for the recoilable wire further includes attachment means suitable for attaching the housing to the clothing of a golfer.

8. The golf utility device of claim 1, wherein the length of the recoilable wire ranges from about one (1) foot to about two hundred (200) feet.

9. The golf utility device of claim 1, wherein the length of the recoilable wire ranges from about ten (10) feet to about one hundred (100) feet.

10. The golf utility device of claim 1, wherein the length of the recoilable wire ranges from about twenty five (25) feet to about fifty (50) feet.

11. The golf utility device of claim 1, wherein the housing for the recoilable wire includes at least one substantially flat face available for information display.

12. The golf utility device of claim 1, wherein the housing for the recoilable wire includes at least one substantially flat face available for information display.

13. A golf shoe and golf club cleaning device comprising:

a brush head member with a generally flat upper face portion and a generally flat lower face portion, said brush head member further consists of a single field of bristles embedded in the generally flat portion of the lower face portion;

a longitudinally extending brush handle member having two end portions, proximal and distal, and two face portions, upper and lower;

wherein the upper face portion of said brush head member is acutely connected to the proximal end of the brush handle member;

wherein the handle includes an aperture through the distal end;

an uncoilable and recoilable attachment means having a first end and a second end, with the first end attached to the handle member through the aperture and the second end secured within a housing unit for said attachment means, said attachment means further comprising measurement indications thereon;

the housing unit having retaining means affixed thereto for removably attaching the housing unit to a convenient surface.

14. The device of claim 13, wherein said retaining means is a generally U-shaped clip means.

15. The device of claim 13, wherein the uncoilable and recoilable attachment means is a substantially flat tape.

16. The device of claim 13, wherein the uncoilable and recoilable attachment means is a wire.

* * * * *